United States Patent [19]

Dieckhaus

[11] 4,199,143

[45] Apr. 22, 1980

[54] PINBALL FLIPPER

[75] Inventor: Joachim G. Dieckhaus, Hanover, Fed. Rep. of Germany

[73] Assignee: Bally Manufacturing Corporation, Chicago, Ill.

[21] Appl. No.: 872,900

[22] Filed: Jan. 27, 1978

[51] Int. Cl.[2] ..... A63F 7/10

[52] U.S. Cl. ..... 273/121 A; 273/129 V

[58] Field of Search ..... 273/129 R, 129 HA, 129 HB, 273/118 A, 119 A, 120 A, 121 A, 122 A, 123 A, 124 A, 125 A, 94 R, 9, 175; 272/68

[56] References Cited

U.S. PATENT DOCUMENTS

| | | | |
|---|---|---|---|
| 1,017,356 | 2/1912 | Whiting | 272/68 |
| 1,536,616 | 5/1924 | Manning | 273/175 |
| 1,615,899 | 2/1927 | Bjorkman | 273/9 |
| 3,216,259 | 11/1965 | Bendix, Jr. | 272/68 |
| 3,298,691 | 1/1967 | Berninger et al. | 273/129 HA |
| 3,807,729 | 4/1974 | Sigma | 272/68 |

FOREIGN PATENT DOCUMENTS

| | | | |
|---|---|---|---|
| 97425 | 7/1924 | Fed. Rep. of Germany | 272/68 |

*Primary Examiner*—Richard C. Pinkham
*Assistant Examiner*—T. Brown
*Attorney, Agent, or Firm*—Robert E. Wagner; Gerald T. Shekleton

[57] ABSTRACT

An improved flipper bar used with a pinball game apparatus allowing increased challenges for skilled players and increased unpredictability in ball trajectory for unskilled players, comprising a cantilevered arm having a series of undulations on one side and disposed perpendicular to the playing field.

5 Claims, 3 Drawing Figures

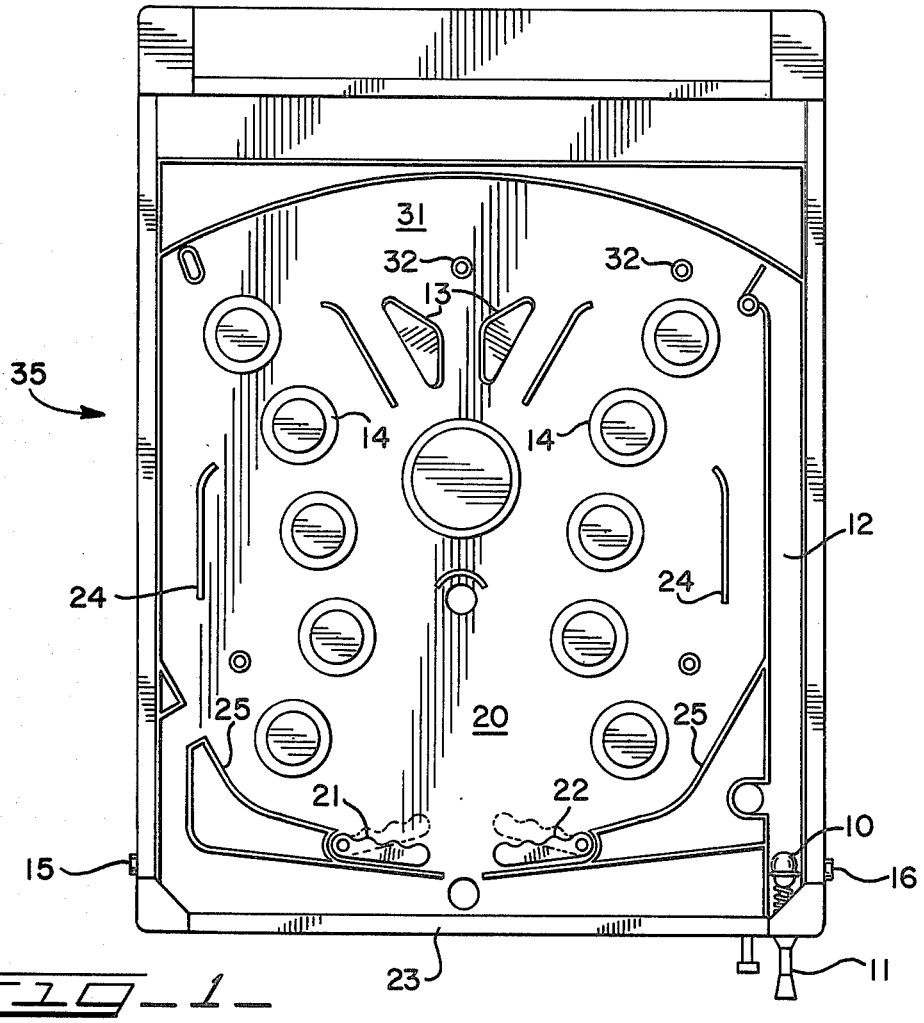
FIG. 1
FIG. 2
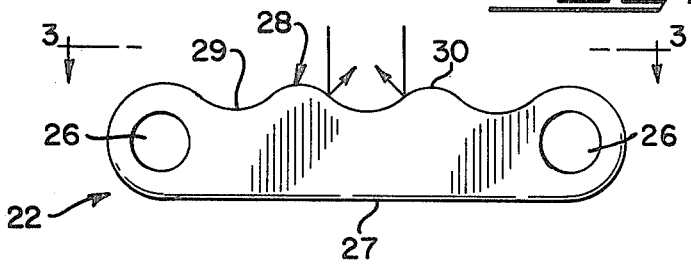
FIG. 3
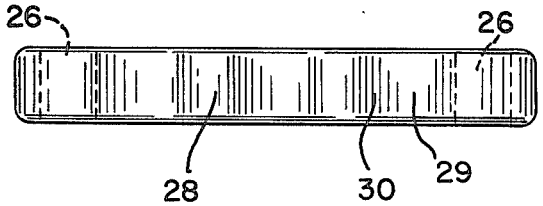

PINBALL FLIPPER

BACKGROUND OF THE INVENTION

This application relates to an amusement device and, more specifically, to a flipper or bumper device used in ball rolling or pinball games to strike a ball and impel it away from the bumper.

In present amusement devices, such as a pinball machine, flipper arms or bumpers are used to deflect the ball away from an out-of-play area and toward a scoring area on the playing field. Such flipper arm units may be actuated by an actuating mechanism and circuit as disclosed in U.S. Pat. No. 3,298,691, which allows the flipper arm to be held indefinitely in an extended position to thereby reposition the ball for "flipping" the ball back onto the playing field. The direction of travel of the ball is largely determined by how far the player permits the momentarily released ball to travel down the length of the arm before actuating the flipper arm to the extended position. Thus, by skillful judgment and timing, an experienced player may procure a variety of trajectories of the ball toward various desired scoring targets by such manipulation and positioning of the flipper bar relative to the position of the ball. Such a skillful player could, with sufficient experience in the practice of the game, readily achieve a level of play which would present no challenge to the player in the play of the game.

SUMMARY OF THE INVENTION

Therefore, an object of the subject invention is an improved flipper bar for use in a pinball game apparatus.

A further object of the subject invention is an improved flipper bar which will inject a greater element of chance in the playing of a pinball apparatus.

A still further object of the subject invention is an improved flipper bar which will provide a new and better challenge for skillful players of a pinball apparatus to master.

These and other objects are attained in accordance with the present invention wherein there is provided a flipper bar or bumper bar for use in a pinball game apparatus. The flipper bar of the subject invention comprises a cantilever arm pivotal at a supporting end for swinging in a horizontal plane, or the plane of the playing field. The flipper bar is generally located at the bottom of a playing field on the pinball apparatus and is actuated by suitable means to pivot at the desired time and strike a ball which is in play on the playing field. Of course, a plurality of flipper arms may be positioned at various locations on the playing field. In contrast to flipper bars of the prior art having substantially flat surfaces for contact with the ball, the flipper bar of the subject invention includes an undulated impact surface, that is, an impact surface having a series of crests and troughs in a plane perpendicular to the plane of the playing field. The undulations in the flipper bar impact surface allow an increased variety of possible trajectories for both the skilled player and the novice. In addition, the skilled player will be challenged to improve his skill and coordination in directing the ball to a desired spot on the playing area through the use of the undulations on the inventive flipper bar. A novice will experience a wider variety of unexpected ball trajectories, resulting in more unpredictability in the course of the ball to yield more unexpected and, thus, more amusement and diversion for the player.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein:

FIG. 1 is a top plan view of a pinball apparatus showing the use of the flipper bars of the subject invention;

FIG. 2 is a top plan view of one embodiment of the flipper bar of the subject invention; and, FIG. 3 is a side view of the flipper bar of FIG. 2 taken along the line 3—3.

Referring now to FIG. 1, there is shown a pinball apparatus 35 of standard construction, generally providing a ball 10 which is set in motion by a spring actuated impeller 11 to travel up pathway 12 into an upper playing area 31 where it may encounter various scoring devices such as shown at 32. The ball 10 passes from the upper playing area 31, rolling through obstructions 13 to encounter a plurality of circular scoring bumpers or devices 14, which may be arranged in any desired manner. The ball 10 can engage these circular scoring bumpers 14 and rebound through to engage linear scoring bumpers 24 and 25 in the lower playing area 20. At this point, the path of the ball may enter into the ball return zone 23 or remain on the playing field through contact with the flipper bars 21 or 22. The player then reacts to the oncoming ball and presses the respective button 15 or 16 to extend the respective flipper bars 21 and 22, thereby propelling the ball 10 upward to re-engage the scoring devices 14 and, if possible, reenter the upper playing area 31 to engage the scoring device 32 and start the entire sequence over to increase the score.

As pinball games commonly employ scoring practices which continually change the relative scoring values each time a bumper is engaged, the capability of responding to these scoring changes by controlling the direction of the rebound of the ball is very desirable.

Of course, any type pinball apparatus having any desired combination of scoring devices such as stationary bumper bars and the like may be employed with the inventive flipper bars of the subject invention. The pinball apparatus shown in FIG. 1 is described for use as one example of an apparatus in which the subject invention may be used.

As shown in FIG. 2, the flipper bar of the subject invention is a cantilever arm pivotally attached to the playing surface. While shown to be symmetrical about a center line, other shapes may be utilized. Flipper arm 22 pivots about the opening 26 to reach an extended position, shown in dotted lines in FIG. 1, by the engagement of button 15 which actuates a solenoid (not shown) to pivot the flipper arm. The flipper arm 22 itself has a back side 27 and a front ball-engaging side 28. The ball-engaging side 28 comprises a series of longitudinally disposed undulations or ripples having successive troughs or depressions 29 and crests or elevations 30 disposed in a plane perpendicular to the playing surface.

Through the skillful use of the undulations of the flipper arm, a player may control either the velocity or direction of the ball being hit. The velocity of the ball may be controlled from fast to slow through the use of the troughs 29 and the crests 30. For example, should a ball 10 strike the flipper bar 22 in a trough 29, the ball 10 will contact more surface on the flipper bar, thereby absorbing more of the striking force of the flipper bar so that the ball rebounds with a slower velocity. On the other hand, should the ball 10 strike the flipper bar 22 on a crest 30, less of the ball surface will contact the flipper bar, more force of the pivoting flipper bar will be transmitted to the ball, and the ball will rebound off the flipper bar 22 with a greater velocity than normal. Of course, this control of velocity is in addition to the variations which are evident upon striking the flipper bar at various axial distances from the pivot point 26. Thus, the ball 10 will travel with greater velocity on that crest farthest from the pivot point and the slowest velocity when striking the trough 29 closest to the pivot point.

The direction of the ball may be controlled by utilizing that area of the impact surface of the flipper bar 22 between the crest 30 and the trough 29. As shown by the arrows in FIG. 2 depicting the possible paths which a ball may take, a ball may be directed into opposite directions on the playing field, dependent upon the exact portion of the flipper bar impact surface 28 which is hit. In such a manner, a skillful player will be able to predictably direct the ball to that portion of the playing field which would currently yield the highest score.

Less skillful players will experience the above-described changes in speed and direction of the ball, however, they will be of an unpredictable nature, yielding a more amusing and entertaining game. While the embodiment of the flipper bars of the subject invention shown in FIGS. 2 and 3 have undulations of a certain number and angle, the invention has been intended to include varying numbers of such undulations disposed at either different or similar angles to one another.

In one embodiment the crests 30 and troughs 29 are uniform in size and of such a dimension and curvature as will allow a ball 10 to strike the bottom or midpoint of the trough. Nonuniform crests 30 and troughs 29 are also contemplated as within the scope of the invention and will provide an extra dimension of unpredictability. The troughs 29 and crests 30 may also be elongated, providing a relatively flat impact surface at the midpoint of each, thereby affording more control of the ball 10 to a novice. In another embodiment, the curvature of the troughs 29 and crests 30 closely approximates the curvature of the ball 10, thereby making control of the ball much more difficult and more challenging to a skilled player.

The flipper bar 22 may be produced so as to be capable of pivotal attachment to the playing field at either end of the cantilever arm. In such embodiment the arm 22 is symmetrical about a center line and has an opening 26 formed at each end for selective attachment at the desired end. In this manner, only one mold is needed for forming both flipper bars for the pinball game.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the subject invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A pinball apparatus having a pinball, a playing surface and a flipper bar for the controlled rebound of said pinball into play on the playing surface of the pinball apparatus, said flipper bar comprising a cantilever arm pivotal about an axis on an end portion of said arm and responsive to a force for generating pivotal movement in a substantially horizontal plane about said axis, said arm having an impact side, at least two crests and at least one trough formed on said impact side in a plane perpendicular to said playing surface, said impact side thereby pivoting about said axis for rebounding said pinball in different forward directions onto said playing surface.

2. The flipper bar of cliam 1 wherein said cantilever arm has a back side opposite said impact side, said back side being substantially straight.

3. The flipper bar of claim 1 wherein said cantilever arm is symmetrical about a line drawn through its mid-section.

4. The flipper bar of claim 1 wherein said crests and troughs are of uniform size.

5. A pinball apparatus having a pinball, a playing surface and a flipper bar for the controlled rebound of said pinball into play on the playing surface of the pinball apparatus, said flipper bar comprising a cantilever arm having opposing end portions and a pivotal attachment means formed in each end portion, said cantilever arm being selectively attached at either of said end portions for pivotal movement about an axis in said end portion, said arm having an impact side, said impact side having at least two crests and at least one trough longitudinally disposed in a plane perpendicular to said playing surface permitting said pinball to be hit in different directions by said flipper bar.

* * * * *